US011274675B2

(12) United States Patent
Sixsmith

(10) Patent No.: US 11,274,675 B2
(45) Date of Patent: Mar. 15, 2022

(54) SHAFT SEAL

(71) Applicant: Plasticair Inc., Mississauga (CA)

(72) Inventor: Paul Sixsmith, Toronto (CA)

(73) Assignee: Plasticair Inc., Mississauga (CA)

( * ) Notice: Subject to any disclaimer, the term of this patent is extended or adjusted under 35 U.S.C. 154(b) by 189 days.

(21) Appl. No.: 16/567,828

(22) Filed: Sep. 11, 2019

(65) Prior Publication Data

US 2020/0003221 A1 Jan. 2, 2020

Related U.S. Application Data

(62) Division of application No. 15/615,285, filed on Jun. 6, 2017, now abandoned.

(60) Provisional application No. 62/350,227, filed on Jun. 15, 2016.

(51) Int. Cl.

| | |
|---|---|
| ***F04D 29/10*** | (2006.01) |
| ***F04D 27/00*** | (2006.01) |
| ***B08B 15/02*** | (2006.01) |
| ***B08B 15/00*** | (2006.01) |
| ***F04D 29/26*** | (2006.01) |
| ***F04D 29/42*** | (2006.01) |
| ***F04D 29/044*** | (2006.01) |
| ***F23L 17/00*** | (2006.01) |

(52) U.S. Cl.

CPC ..... *F04D 29/106* (2013.01); *B08B 15/002* (2013.01); *B08B 15/02* (2013.01); *F04D 27/008* (2013.01); *F04D 29/104* (2013.01); *F04D 29/263* (2013.01); *F04D 29/4226* (2013.01); *F04D 29/044* (2013.01); *F05B 2260/603* (2013.01); *F23L 17/005* (2013.01)

(58) Field of Classification Search

CPC .. F16J 15/545; F16J 15/54; F16J 15/40; F16J 15/406; F04D 29/104; F04D 29/106; F04D 29/4226; F04D 27/008; F04D 25/08; F04D 25/166; F05B 2260/604; B08B 15/002

See application file for complete search history.

(56) References Cited

U.S. PATENT DOCUMENTS 2,604,617 A * 7/1952 Dietz ..... A21C 1/06 318/520
2,959,070 A * 11/1960 Flinn ..... F16H 3/72 74/664
3,081,096 A * 3/1963 Woodbury ..... F16J 15/40 277/431

(Continued)

*Primary Examiner* — Courtney D Heinle
*Assistant Examiner* — Andrew Thanh Bui
(74) *Attorney, Agent, or Firm* — Honigman LLP

(57) ABSTRACT

A shaft seal for an exhaust fan. The seal limits leakage from within an exhaust fan housing around an exhaust fan drive shaft that extends between a rotational power source exterior to the exhaust fan housing and a position within the exhaust fan housing. The seal comprises a plenum generally positioned about the exhaust fan drive shaft at the point where the shaft extends into the fan housing; an auxiliary blower comprising a housing, an internal blade driven by an auxiliary blower drive shaft, and an auxiliary blower drive to rotate the drive shaft where the auxiliary blower drive is operatively associated with the rotational power source such that operation of the rotational power sources causes a rotation of the exhaust fan drive shaft and the auxiliary blower drive shaft; and a duct fluidly connecting the auxiliary blower housing to the plenum.

9 Claims, 5 Drawing Sheets

(56) References Cited

U.S. PATENT DOCUMENTS

| | | | | | |
|---|---|---|---|---|---|
| 3,172,671 | A * | 3/1965 | Downs | F16J 15/30 | 277/543 |
| 3,272,516 | A * | 9/1966 | Hoffman | F04D 29/122 | 277/431 |
| 3,921,793 | A * | 11/1975 | Hutchinson | B65G 23/44 | 198/813 |
| 4,350,345 | A * | 9/1982 | Kalan | F16J 15/40 | 277/347 |
| 5,738,167 | A * | 4/1998 | Asbjornson | F04D 29/4226 | 165/122 |
| 7,338,400 | B2 * | 3/2008 | Pierjok | F16H 7/14 | 417/359 |
| 10,054,130 | B1 * | 8/2018 | Johansen | F04D 29/102 | |

* cited by examiner

SHAFT SEAL

RELATED APPLICATION

This U.S. patent application is a division of, and claims priority under 35 U.S.C. § 120 from, U.S. patent application Ser. No. 15/615,285, filed on Jun. 6, 2017, which claims priority under 35 U.S.C. § 119(e) to U.S. Provisional Application 62/350,227, filed on Jun. 15, 2016. The entire contents of these applications are incorporated herein by reference in their entirety.

FIELD

This invention relates generally to seals for limiting leakage of fluid from around a shaft and into the surrounding environment. In one embodiment the invention relates to such a seal for use on an exhaust fan.

BACKGROUND

Sealing around a rotating shaft is a common place in industry and in numerous mechanical applications. Often a rotating shaft is required to pass into a housing or "area" containing a fluid, where there is a desire to avoid the passage or leakage of the fluid from about the shaft and into the environment outside the housing. One such example is an exhaust fan where the fan blade is rotated by a shaft that is driven by an externally mounted motor. In such instances a shaft seal will typically be mounted about the shaft at its point of entry into the fan housing in order to help limit the passage of gas from within the housing to the exterior environment.

In some instances the integrity of a shaft seal is important from a health and safety perspective. For example, in certain industrial applications exhaust fans are used to exhaust toxic, corrosive, noxious, flammable or corrosive gases. Where the fan motor or other drive mechanism is located outside the fan housing, a shaft seal will be required to help prevent gas from leaking from around the rotating shaft and into the ambient environment. Although in most cases the seals between the shaft and the housing are constructed to be "tight", they nevertheless often only limit leakage and never completely stop leakage entirely. In other cases, where very high integrity seals are utilized, the components of the seal can wear and degrade over time, which can allow a once highly efficient seal to leak. In instances where highly toxic or otherwise dangerous gases are being exhausted, leakage of even small volumes of gas can be problematic.

SUMMARY

Accordingly in one aspect the invention provides a shaft seal for an exhaust fan, the shaft seal limiting the leakage of a fluid from within an exhaust fan housing around an exhaust fan drive shaft that extends between a rotational power source exterior to the exhaust fan housing and a position within the exhaust fan housing, the shaft seal comprising a plenum generally positioned about the exhaust fan drive shaft at the point where the exhaust fan drive shaft extends into the exhaust fan housing; an auxiliary blower comprising an auxiliary blower housing, an internal auxiliary blower blade or impeller driven by an auxiliary blower drive shaft, and an auxiliary blower drive to rotate the auxiliary blower drive shaft, said auxiliary blower drive operatively associated with the rotational power source such that operation of said rotational power sources causes a rotation of said exhaust fan drive shaft and said auxiliary blower drive shaft; and a duct fluidly connecting said auxiliary blower housing to said plenum, such that during operation of the auxiliary blower the pressure within said plenum is greater than the ambient pressure exterior to said plenum and greater than the pressure within the exhaust fan housing.

In another aspect the invention provides a shaft seal for an exhaust fan, the shaft seal limiting the leakage of gas from within an exhaust fan housing past an exhaust fan drive shaft extending between an external exhaust fan motor and an exhaust fan blade or impeller within the exhaust fan housing, the shaft seal comprising a plenum generally positioned about the exhaust fan drive shaft at the point where the exhaust fan drive shaft extends into the exhaust fan housing; an auxiliary blower comprising an auxiliary blower housing, an internal auxiliary blower blade or impeller driven by an auxiliary blower drive shaft, and an auxiliary blower drive comprising a first pulley mounted on said auxiliary blower drive shaft and rotated by a belt driven by a second pulley mounted to either the exhaust fan drive shaft or to a rotating shaft of the exhaust fan motor; and a duct fluidly connecting said auxiliary blower to said plenum; wherein, during operation of the auxiliary blower the pressure within said plenum is greater than the ambient pressure exterior to said plenum and greater than the pressure within the exhaust fan housing.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

Figure 1:
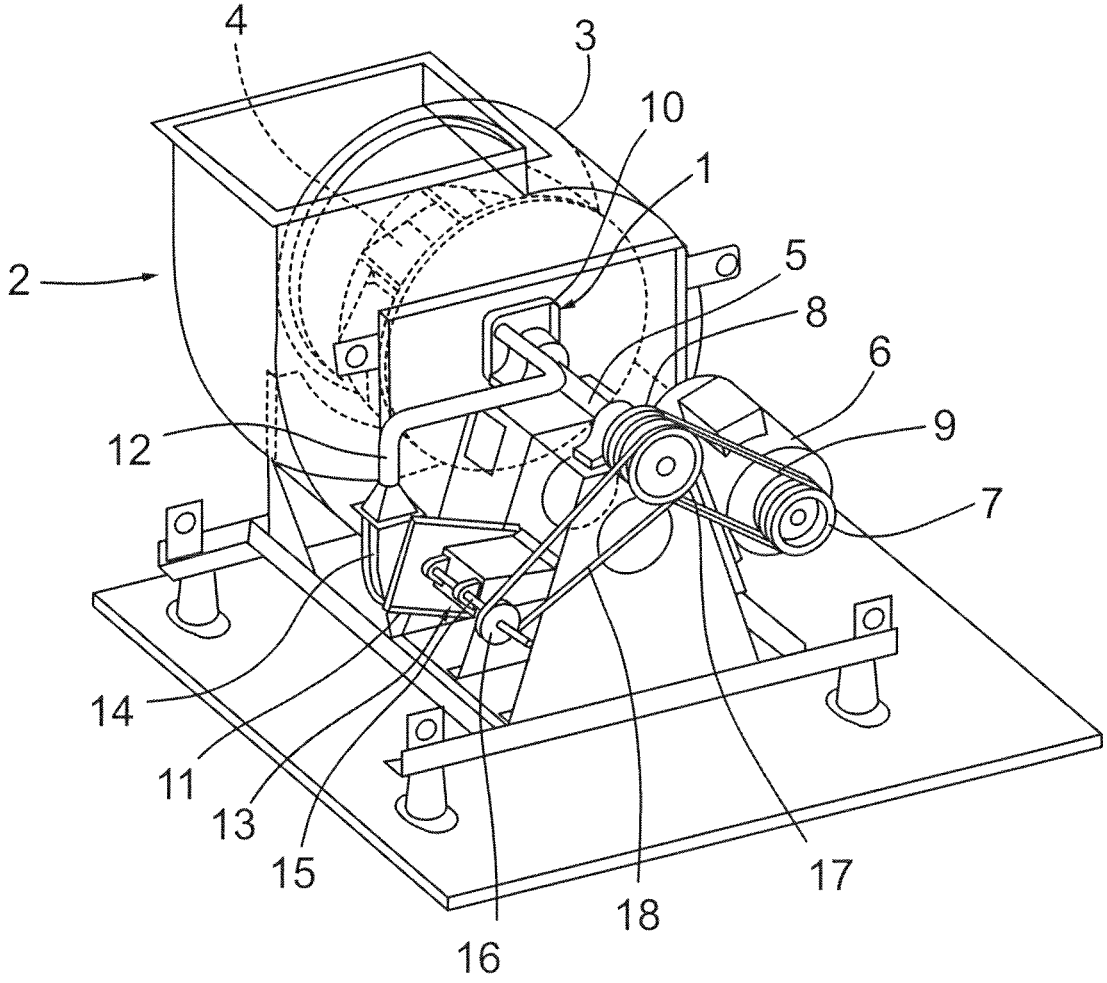
FIG. 1 in an upper front perspective view of an exhaust fan with a shaft seal constructed in accordance with an embodiment of the invention.
Figure 2:
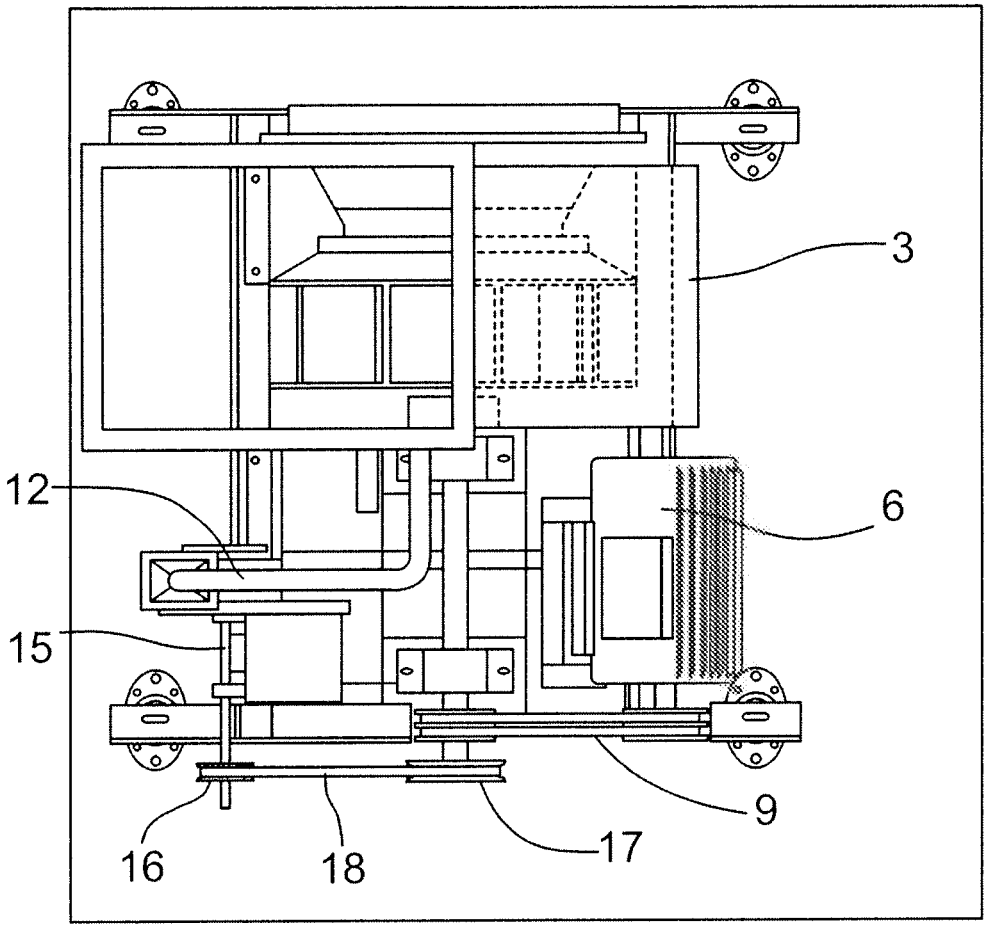
FIG. 2 is a plan view of the exhaust fan shown in FIG. 1.

The present invention may be embodied in a number of different forms. The specification and drawings that follow describe and disclose some of the specific forms of the invention.

A preferred embodiment of the present invention is shown in the attached Figures. In the Figures, the seal of the invention is noted very generally by reference numeral 1 and has been applied to an exhaust fan 2. It will be appreciated that while in the attached drawings exhaust fan 2 is shown as a centrifugal fan, in an alternate embodiment exhaust fan 2 could be an axial flow fan. In general, fan 2 will include a fan housing 3 containing an exhaust fan blade or impeller 4 that is rotated by an exhaust fan drive shaft 5 extending through the side of fan housing 3. Exhaust fan drive shaft 5 is rotated by a rotational power source. Typically the rotational power source will be a direct drive exhaust fan motor 6 (such as in the case of the embodiment of FIG. 3) or, alternatively, an indirect drive system comprising an exhaust fan motor 6, a fan motor pulley 7 mounted to the shaft of motor 6, an exhaust fan drive shaft pulley 8 mounted to the exhaust fan drive shaft, and an exhaust fan belt 9. It will be appreciated that the described structure of exhaust fan 2 is relatively conventional.

The point where exhaust fan drive shaft 5 extends through the side of fan housing 3 presents a location for the potential leakage of pressurized fluid (gas) from within housing 3 into the surrounding exterior environment. In some instances, the nature of the gas being exhausted is such that leakage is of little concern, aside from matters touching on efficiency. However, in other instances there may be noxious or other dangerous gases within the exhaust gas stream where leakage is of a significant concern. In such cases a seal of some sort would typically be positioned between rotating exhaust fan drive shaft 5 and housing 3 in order to help limit the leakage of gas around the shaft.

In accordance with the invention, there is provided a shaft seal 1 that comprises, in general, a plenum 10, an auxiliary blower 11, a duct 12, and an auxiliary blower drive 13. Plenum 10 is positioned about exhaust fan drive shaft 5 such that it surrounds the drive shaft and creates a generally enclosed volume about the point where the exhaust fan drive shaft extends through exhaust fan housing 3. In the attached drawings, plenum 10 is shown as a generally square shaped structure, however, the plenum could equally be any one of a variety of different shapes. Since rotating exhaust fan drive shaft 5 will extend through the side of plenum 10, a dynamic seal may be placed between the plenum and rotating exhaust fan drive shaft 5. Any one of a wide variety of commonly utilized seals could be used between the plenum and exhaust fan drive shaft 5. From an understanding of the structures described below it will also be appreciated that the seal between the plenum and exhaust fan drive shaft 5 (such seal not shown specifically in the drawings) is intended to help maintain pressurized gas within the plenum.

As shown in the attached drawings, duct 12 fluidly connects auxiliary blower 11 with plenum 10. Auxiliary blower 11 will be in the form of a relatively standard fan or blower comprised generally of an auxiliary blower housing 14 having an internal auxiliary blower fan blade or impeller (not shown) driven by an auxiliary blower drive shaft 15. Through rotation of auxiliary blower drive shaft 15, the auxiliary blower draws in ambient atmospheric air and directs that air to plenum 10 via duct 12. In accordance with the invention, fluid or air is delivered to plenum 10 in a manner such that during operation of auxiliary blower 11 the pressure within plenum 10 is greater than the ambient pressure of its exterior environment and greater than the pressure within exhaust fan housing 3. It will also be appreciated that the size of auxiliary blower 11, its design, the speed at which auxiliary blower drive shaft 15 is rotated, the size of duct 12 and plenum 10, etc., will all be design elements that will vary from application to application and that will all be, to a certain extent, inter-related. Those factors and others will determine the degree of pressurization of plenum 10, which will vary from application to application. During operation the auxiliary blower the pressure within plenum 10 should normally exceed that of the exterior environment and the pressure within exhaust fan housing 3. In that way, a localized "high" pressure zone will be created about the position where exhaust fan drive shaft 5 enters exhaust fan housing 3. That "high" pressure will ensure that lower pressure gas within the interior of exhaust fan housing 3 is prevented from leaking past around the rotating exhaust fan drive shaft and into the environment within which the exhaust fan is situated.

In one embodiment of the invention the auxiliary blower is driven by the same power source as the exhaust fan. In the particular embodiment shown in FIG. 1, auxiliary blower drive 13 comprises a first pulley 16, mounted on auxiliary blower drive shaft 15, that is driven by a belt 18 that extends between first pulley 16 and a second pulley 17 mounted on exhaust fan drive shaft 5. In an alternate embodiment second pulley 17 could be mounted directly on the shaft of exhaust fan motor 6. When belt 18 is engaged on both pulleys, rotation of pulley 17 by either exhaust fan drive shaft 5 or directly by exhaust fan motor 6 causes a rotation of auxiliary blower drive shaft 15. One of skill in the art will appreciate that the relative sizing of the pulleys can be altered to change the speed of rotation of the auxiliary blower drive shaft, and hence the volume and pressure of air delivered to plenum 10. It will also be appreciated that other structures and manners of powering both the auxiliary blower and the exhaust fan from the same source could be utilized.

Figure 3:
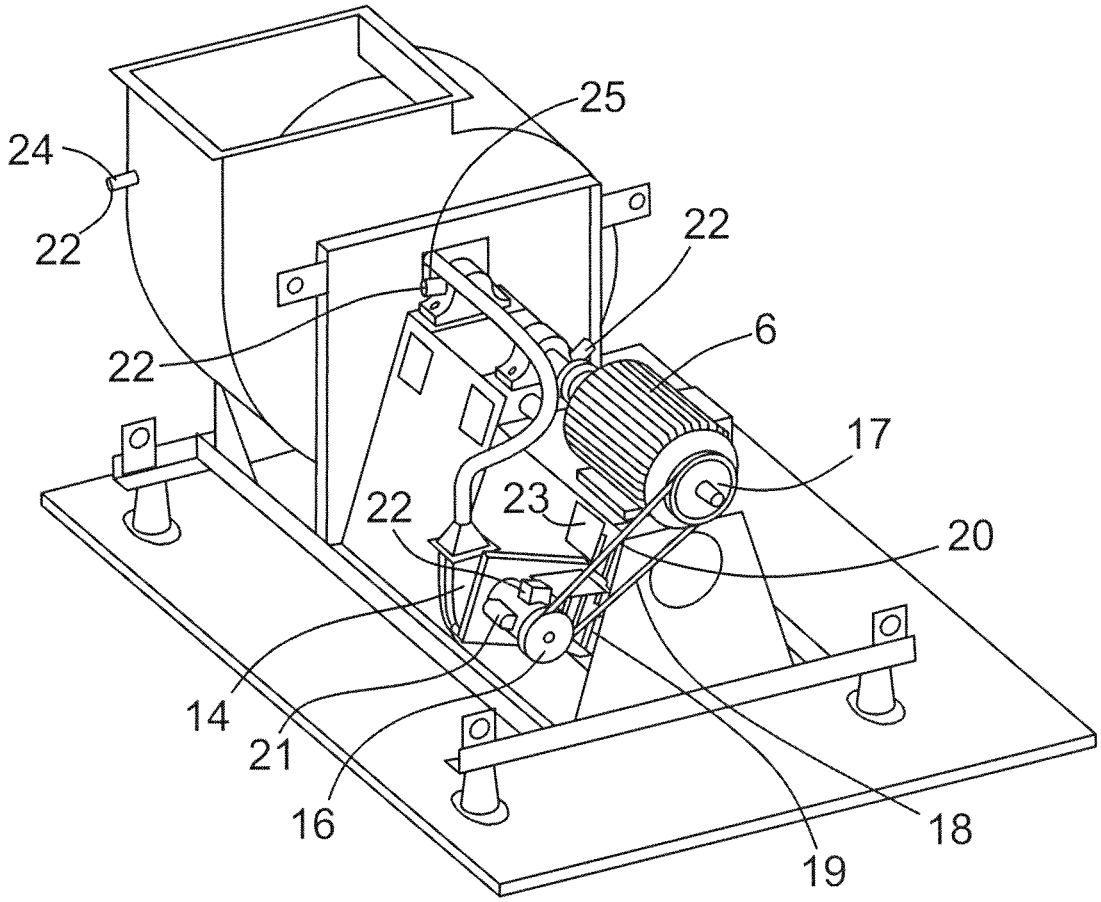
FIG. 3 is an upper front perspective view of an exhaust fan with a shaft seal constructed in accordance with an alternate embodiment of the invention to that shown in FIG. 1.
Figure 4:
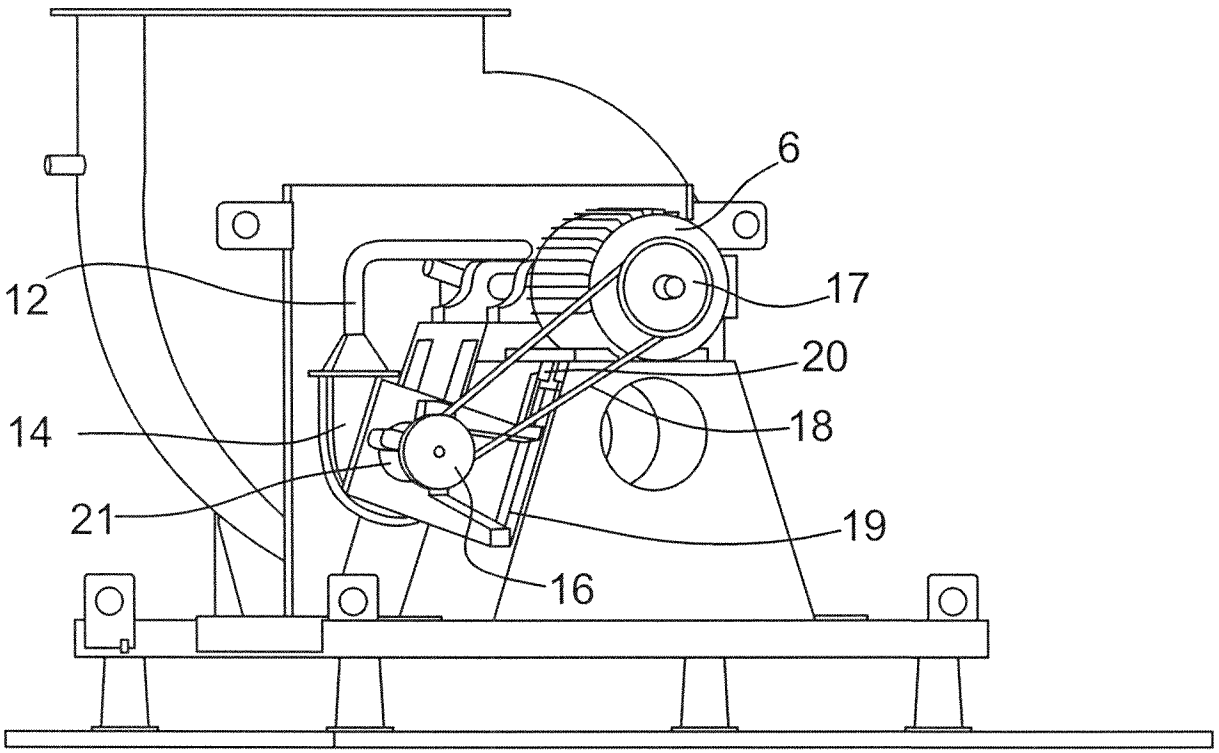
FIG. 4 is an enlarged detail view of the device shown in FIG. 3.
Figure 5:
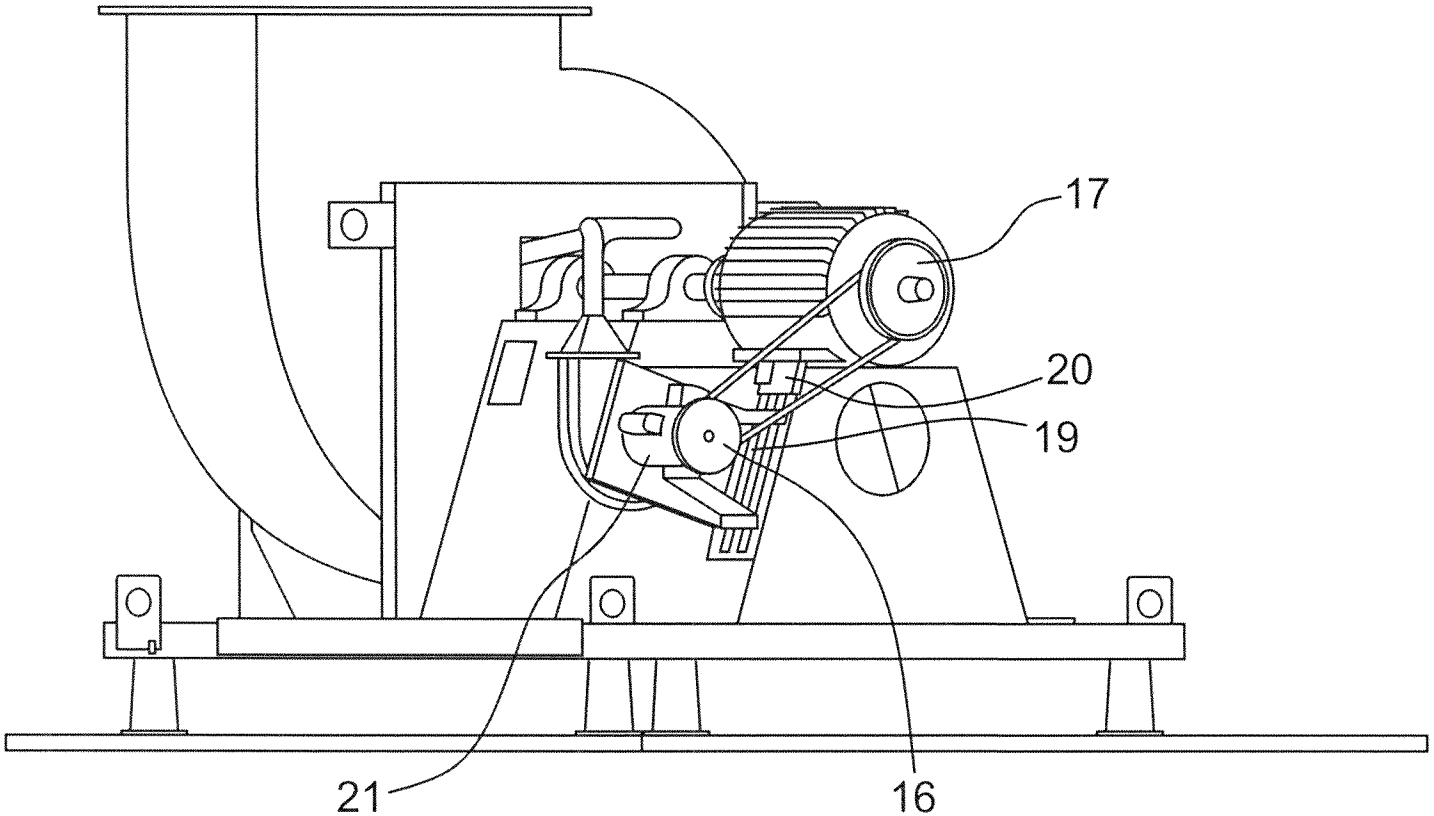
FIG. 5 is an enlarged detail view of the device shown in FIG. 3 wherein the linear actuators have been engaged and the auxiliary blower is disengaged from the exhaust fan motor.

Referring next to FIGS. 3 through 5, there is shown an alternate embodiment of the invention wherein auxiliary blower 11 is slidably mounted upon a track 19 such that the position of pulley 16 relative to pulley 17 can be altered between a position where belt 18 engages first and second pulleys 16 and 17, and a position where belt 18 is effectively disengaged from each of the said pulleys. Where belt 18 is fully engaged with first and second pulleys 16 and 17, rotation of pulley 17 will cause a rotation of auxiliary blower drive shaft 15. Similarly, where belt 18 is disengaged from first and second pulleys 16 and 17, auxiliary blower drive shaft 15 will no longer be rotated by pulley 17.

In the embodiment of the invention depicted in the attached drawings, one or more linear actuators 20 slidably move auxiliary blower 13 along a track 19 from a position where belt 18 engages pulleys 16 and 17, to a position where belt 18 is disengaged from pulleys 16 and 17. It is expected that in some instances linear actuators 20 will be comprised of one or more solenoids. In other instances, the actuators could be one of a variety of different structures, including but not limited to, jack screws, bull/worm gear drives, etc. To facilitate the movement of auxiliary blower 11 along track 19, at least a portion of duct 12 may be flexible or telescopic.

In the particular embodiments shown in FIGS. 3 through 5, auxiliary blower 11 further includes an auxiliary blower motor 21 that, when activated, causes a rotation of auxiliary blower drive shaft 15. Although not critical, in this particular instance auxiliary blower motor 21 is shown to be in-line with auxiliary blower drive shaft 15, with the shaft of motor 21 extending out both of its ends. One end of the shaft of auxiliary blower motor 21 will be connected to auxiliary blower drive shaft 15 with the opposite end fitted with first pulley 16. It will also be noted that in the particular embodiment shown, exhaust fan motor 6 is in-line with exhaust fan drive shaft 5, however, such need not be the case.

With the incorporation of auxiliary blower motor 21 within the design of auxiliary blower 11, it becomes possible to provide a positive or "high" pressure within plenum 10 regardless of the operational status of exhaust fan motor 6. That is, when exhaust fan motor 6 is operational and rotating, the auxiliary blower will preferably be in a position upon track 19 such that belt 18 engages each of pulleys 16 and 17. With belt 18 so engaged, auxiliary blower 11 will effectively be activated by the rotation of exhaust fan motor 6, delivering pressurized air to plenum 10. If exhaust fan motor 6 were to fail or otherwise be deactivated, linear actuators 20 can be utilized to "disengage" auxiliary blower 11 from exhaust fan drive shaft 5 through moving the auxiliary blower closer to the exhaust fan drive shaft, to a point where belt 18 no longer "engages" first and second pulleys 16 and 17. At that point auxiliary blower motor 21 can be activated to cause auxiliary blower 11 to continue to provide pressurized gas to plenum 10, even though exhaust fan motor 6 is no longer operating. While auxiliary blower motor 21 is operating, belt 18 will simply slip about pulley 16 and/or 17. The ability to continue to provide a source of pressurized air or gas to plenum 10 when the exhaust fan motor is no longer operational can be advantageous in circumstances where, even though the exhaust fan motor is no longer rotating, there continues to exist a source of noxious or otherwise dangerous gas within exhaust fan housing 3.

In accordance with an aspect of the invention, there may be included one or more sensors 22 to determine whether exhaust fan motor 6 is operating. Sensors 22 could be any one of a variety of different sensors including, motion sensors, current sensors, etc. The output from sensor or sensors 22 may be fed to a microprocessor control 23, which in turn can operate linear actuators 20. Should sensor or sensors 22 fail to sense the operation of exhaust fan motor 6, microprocessor control 23 will be able to cause linear actuators 20 to effectively disengage belt 18 from first and second pulleys 16 and 17, and to then activate or "start" auxiliary blower motor 21 to permit auxiliary blower 11 to continue to provide pressurized gas to plenum 10.

It will also be appreciated that microprocessor control 23 adds the potential for a degree of possible automation. For example, microprocessor control 23 could be designed to activate the linear actuators to disengage belt 18 from pulleys 16 and 17, and to "start" auxiliary blower motor 21 should the speed of rotation of exhaust fan drive shaft 5 drop below a pre-determined level (determined by a sensor 22), if exhaust fan motor 6 were to stop, if belt 18 were to break, etc. In addition, the microprocessor control could disengage belt 18 and start motor 21 should a pressure sensor 24 in communication with exhaust fan housing 3 show a pressure exceeding or within a pre-determined degree of the pressure within plenum 10, as determined by a pressure sensor 25 in communication with the plenum. Further, auxiliary blower motor 21 could be a variable speed (or dc drive) motor and microprocessor control 23 could disengage belt 18 and operate auxiliary blower motor 21 to control the speed of rotation of auxiliary blower drive shaft 15, as and when appropriate, to ensure that the pressure within plenum 10 exceeds the pressure detected within exhaust fan housing 3. Additional degrees of automation functionality could be programmed into microprocessor 23.

It is to be understood that what has been described are the preferred embodiments of the invention. The scope of the claims should not be limited by the preferred embodiments set forth above, but should be given the broadest interpretation consistent with the description as a whole.

I claim:

1. A shaft seal for an exhaust fan, the shaft seal for limiting the leakage of a fluid from within an exhaust fan housing around an exhaust fan drive shaft that extends between a position exterior to the exhaust fan housing and a position within the exhaust fan housing, the shaft seal comprising:

a plenum positioned about the exhaust fan drive shaft at the point where the exhaust fan drive shaft extends into the exhaust fan housing;

an auxiliary blower comprising an auxiliary blower housing, an auxiliary blower drive shaft, and an auxiliary blower drive to rotate the auxiliary blower drive shaft, said auxiliary blower drive comprising a first pulley mounted to said auxiliary blower drive shaft, said first pulley rotated by a belt driven by a second pulley mounted to either the exhaust fan drive shaft or to a rotating shaft of an exhaust fan motor; and a duct fluidly connecting said auxiliary blower housing to said plenum, said auxiliary blower mounted upon a track such that the position of said first pulley relative to said second pulley can be altered between a position wherein said belt engages each of said first and said second pulleys such that rotation of said second pulley causes a rotation of said first pulley, and a position wherein said belt is disengaged from one or both of said first and second pulleys, said track comprising one or more solenoids to move said auxiliary blower drive shaft between said respective positions wherein during operation of the auxiliary blower the pressure within said plenum greater than the ambient pressure exterior to said plenum and greater than the pressure within the exhaust fan housing.

2. The shaft seal as claimed in claim 1 wherein at least a portion of said duct is flexible or telescopic.

3. The shaft seal as claimed in claim 1 wherein said auxiliary blower includes an auxiliary blower motor, wherein operation of said auxiliary blower motor causes a rotation of said auxiliary blower drive shaft.

4. The shaft seal as claimed in claim 3 including a microprocessor control to control the operation of said one or more linear actuators and said auxiliary blower motor.

5. The shaft seal as claimed in claim 4 including at least one sensor to determine whether said exhaust fan drive shaft is rotating, said sensor linked to said microprocessor control such that a failure to sense the rotation of said exhaust fan drive shaft causes said microprocessor control to operate said one or more linear actuators to disengage said belt from said first and second pulleys and to activate said auxiliary blower motor.

6. The shaft seal as claimed in claim 4 including a first pressure sensor in communication with the fan housing and a second pressure sensor in communication with said plenum, said first and second pressure sensors transmitting signals to said microprocessor control permitting said microprocessor control to operate said linear actuators and said auxiliary blower motor to maintain the pressure within said plenum above the pressure within the fan housing.

7. The shaft seal as claimed in claim 1 wherein the exhaust fan is a centrifugal fan or an axial flow fan.

8. A shaft seal for an exhaust fan, the shaft seal limiting the leakage of gas from within an exhaust fan housing past an exhaust fan drive shaft extending between an external exhaust fan motor and an exhaust fan blade or impeller within the exhaust fan housing, the shaft seal comprising:

a plenum positioned about the exhaust fan drive shaft at the point where the exhaust fan drive shaft extends into the exhaust fan housing;

an auxiliary blower comprising an auxiliary blower housing, an auxiliary blower drive shaft, an auxiliary blower motor operatively connected to said auxiliary blower drive shaft, and an auxiliary blower drive comprising a first pulley mounted on said auxiliary blower drive shaft and rotated by a belt driven by a second pulley mounted to either the exhaust fan drive shaft or to a rotating shaft of the exhaust fan motor;

a duct fluidly connecting said auxiliary blower to said plenum, at least a portion of said duct being flexible and said auxiliary blower mounted upon a track, said auxiliary blower including one or more linear actuators such that activation of said one or more linear actuators alters the position of said first and second pulleys between a position wherein said belt engages each of said first and said second pulleys such that rotation of said second pulley causes a rotation of said first pulley, and a position wherein said belt is disengaged from one or both of said first and second pulleys; and a microprocessor control and at least one sensor to determine whether the exhaust fan drive shaft is rotating, wherein a failure to sense the rotation of the exhaust fan drive shaft causes said microprocessor control to operate said one or more linear actuators to disengage said belt from said first and second pulleys and to activate said auxiliary blower motor wherein, during operation of the auxiliary blower the pressure within said plenum is greater than the ambient pressure exterior to said plenum and greater than the pressure within the exhaust fan housing.

9. The shaft seal as claimed in claim 8 wherein the exhaust fan is a centrifugal fan or an axial flow fan.

* * * * *